US005301967A

United States Patent [19]

Sparber

[11] Patent Number: 5,301,967

[45] Date of Patent: Apr. 12, 1994

[54] PROTECTIVE JACKET HAVING DISPLAY TAB

[75] Inventor: Victor W. Sparber, Newport News, Va.

[73] Assignee: Jay Plastics, Inc., Hampton, Va.

[21] Appl. No.: 71,011

[22] Filed: Jun. 2, 1993

[51] Int. Cl.[5] ..... B42D 17/00

[52] U.S. Cl. ..... 281/43

[58] Field of Search ..... 281/43, 45, 29; 402/70, 402/73

[56] References Cited

U.S. PATENT DOCUMENTS 4,200,945 5/1980 Ellis ..... 281/43
4,466,638 8/1984 Miskin ..... 281/29 X
4,484,829 11/1984 Dickenson ..... 281/29 X
4,624,480 11/1986 Marthaler et al. ..... 281/45 X

*Primary Examiner*—Mark Rosenbaum
*Assistant Examiner*—Willmon Fridie, Jr.
*Attorney, Agent, or Firm*—Pennie & Edmonds

[57] ABSTRACT

A jacket for protectively covering an insert comprising a cover material having greater resistance to deterioration than the insert and at least one pocket for receiving at least a portion of the insert. A tab member having an aperture therein is at least partially attached to the cover material for mounting the jacket upon a display rack. The connection has sufficient strength to retain the tab member at least partially secured to the cover material while the jacket is mounted upon the display rack, but facilitates separation and removal of the tab member from the cover material before use thereof.

19 Claims, 1 Drawing Sheet

PROTECTIVE JACKET HAVING DISPLAY TAB

FIELD OF THE INVENTION

The invention relates to protective covers or jackets and, in particular, to a jacket which includes a detachable tab for displaying the jacket and any materials contained therein.

BACKGROUND OF THE INVENTION

Protective covers or jackets are well known in the art. Such jackets are widely used to protect books, notebooks, checkbooks, appointment calendars, and other materials from dirt and contaminants which accelerate wear and tear. The jackets are typically formed of a durable protective material and are available in various sizes. Most commonly, the jackets are formed of a water resistant, cost effective material such as plastic.

Typically, these types of jackets are displayed for promotional purposes in retail establishments. Often the covers are sold in card or stationery stores for use in connection with other products sold in the store. The jackets may be displayed alone or in combination with some form of insert material such as, for example, a calendar or a note pad. When sold alone, the covers are commonly displayed in box or bin-type displays. In these types of displays, the consumer must often hunt through several jackets in order to locate the particular size or color desired, which is both inconvenient and time-consuming.

The jackets may also be displayed on racks or hanging rods, alone or in combination with some form of insert material. When displayed in this manner, the jackets with or without inserts are often sold in wrapping or packaging adapted for the particular display. When purchased, the jacket and any materials contained therein must be removed from the packaging and the packaging discarded prior to use. This packaging produces excess waste and also results in increased costs which are passed along to the consumer.

SUMMARY OF THE INVENTION

In accordance with the invention, a jacket for protectively covering an insert comprises means for covering portions of the insert comprising a material having greater resistance to deterioration than the insert and including means for receiving at least a portion of the insert to properly position the insert adjacent the covering means. The jacket includes means associated with the covering means for mounting the jacket upon a hanging rod display rack. The jacket may further comprise means for at least partially connecting the mounting means to the covering means, the connection means having sufficient strength to retain the mounting means at least partially secured to the covering means while the jacket is mounted upon the display rack, but which facilitates separation and removal of the mounting means from the covering means before use thereof. The separation means may comprises a weakened separation line, stitches or stitching, or a bead seal. The covering means may comprise a sheet of thermoplastic material. The mounting means may comprise a display tab defining an aperture therein for mounting on the hanging rod of the display rack. The receiving means may comprise at least one pocket. The receiving means may further comprise first and second pockets positioned in spaced relation on one side of the covering means. One pocket may be larger than the other. The pocket may be made of a transparent material to facilitate viewing of the insert therein. The thermoplastic sheet may be opaque and pigmented to a desired color.

DETAILED DESCRIPTION OF THE INVENTION

Figure 1:
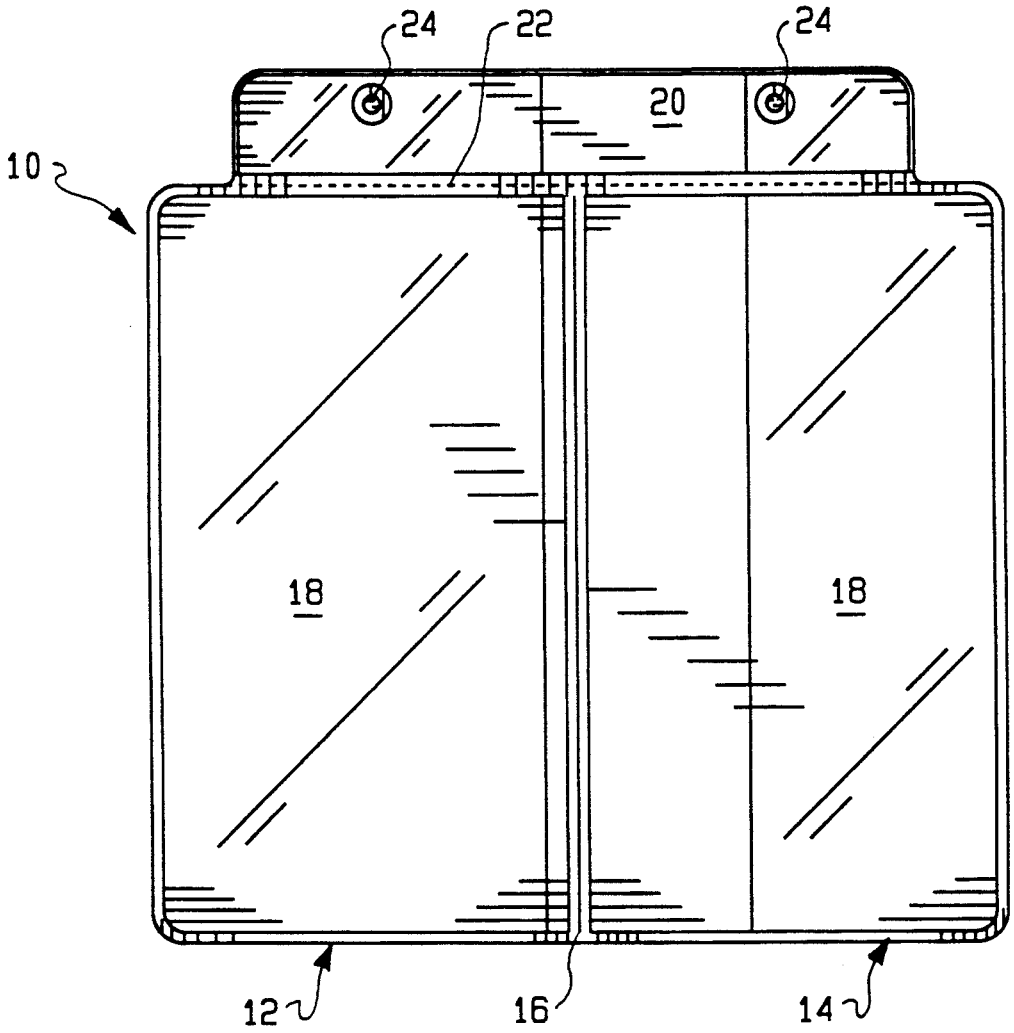
FIG. 1 is a plan view of a book cover in accordance with the present invention.

FIG. 1 illustrates a protective book cover or jacket 10 constructed in accordance with the present invention. The jacket 10 is formed from at least one piece of durable material which is generally a thermoplastic material such as polyvinyl chloride ("vinyl"), polyethylene or other low cost material. This material is generally opaque and of the desired color for the cover. Preferably, the jacket 10 comprises first and second rectangular cover flaps 12, 14 joined to one another along a central seal line 16. Alternative means of attachment, such as adhesives or stitching could also be used to join the cover flaps 12, 14. Each cover flap 12, 14 has a sheet of material, preferably of a transparent thermoplastic material, secured thereto along at least a portion thereof to form a pocket 18. In use, the outer covers of a book, pamphlet, or other insert may be placed within the pockets 18 so that the protective jacket 10 shields the contents therein from dirt, water, and other contaminants which produce wear and tear. The transparent material allows the insert to be viewed.

The jacket 10 further includes an elongated tab member 20 joined to a portion thereof. Preferably, the tab member 20 is joined to the cover flaps 12, 14 by a weakened separation line 22 to facilitate removal as will be described in greater detail below. It will be recognized, however, that other suitable means of attachment such as, for example, stitching or bead seals, could also be used to join the tab member 20 to the cover flaps 12, 14. The member tab 20 includes at least one aperture 24 stamped therein which provides means for mounting the jacket 10 upon the rods of a display rack or upon a display peg as described below.

As will be appreciated, the dimensions of the cover flaps 12, 14 and pockets 18 will vary widely in accordance with the size of the insert to be received therein. In addition, the size and shape of the display tab 20 and apertures 24 may be varied in accordance with the size of the jacket 10 and any insert contained therein, as well as the type of device on which the jacket 10 is to be displayed. Of course, the tab member 20 needs to only be of a size sufficient to accommodate the desired aperture or apertures 24, and needs only to be sufficiently connected to the jacket 10 to retain it on the rods of the display rack or peg. Thus, the weakened separation line 22 may include spaced perforations or other discontinuities for ease in separating it from the jacket.

With the present invention, the jacket 10 may be displayed without the need for additional packaging. In a retail setting, the apertures 24 may be exposed for placement over a rod or peg such that the cover hangs for display. When a jacket 10 is purchased, the cover is simply removed from the display device. Prior to use of the jacket, the tab member 20 is simply and easily removed along the weakened separation line 22 and discarded, thus leaving the protective jacket 10 and contents thereof. Alternatively, if the tab member 20 is attached via a bead seal or stitching, the tab member may be cut away from jacket 10.

Thus, the tab member 20 provides an efficient means for display of the jacket 10 with minimal waste. When attached to the jacket 10 with a weakened separation line 22, such as a score line which weakens but does not cut through the material, the tab 20 may be removed from the jacket with minimal effort, leaving the jacket and contents available for immediate use. The tab member 20 further enables jackets to be displayed in an organized manner according to size and/or color.

To form the preferred protective jacket of the invention, the cover flaps 12, 14 are cut to size and joined along a 1/32" wide bead seal bar 16. The tab member 20 is then joined in a similar manner to the cover flaps 12, 14, except that a weakened separation line 22 which extends across a top edge of the jacket 10, is provided. This can be easily made by scoring the line with a knife blade or other suitable device. Next, the sheets of material 18 are secured to the cover flaps 12, 14 and tab 20 member along the edges thereof along a 1/16" wide bead seal 22 and left open adjacent the center seal line 16 to define pockets 18 on each flap 12, 14. Lastly, the apertures 24 are stamped, cut, or otherwise provided at the desired locations on the tab member 20. Of course, the seal widths described herein are illustrative and may be varied as desired.

As will be apparent, various modifications and adaptations of the embodiments described above will become readily apparent without departure from the spirit and scope of the invention. The scope of which is defined in the appended claims.

What is claimed is:

1. A jacket for protectively covering an insert, comprising:

means for covering portions of the insert comprising a material having greater resistance to deterioration than the insert and including means for receiving at least a portion of the insert to properly position the insert adjacent the covering means, said receiving means comprising a sheet of material which is joined to the covering means along portions of its periphery to form a pocket having three closed sides for receiving a portion of the insert;

means associated with the covering means for mounting the jacket upon a hanging rod display rack; and means for at least partially connecting the mounting means to the covering means, the connecting means having sufficient strength to retain the mounting means at lest partially secured to the covering means while the jacket is mounted upon the display rack, but which facilitates separation and removal of the mounting means from the covering means before use thereof.

2. The jacket of claim 1 wherein the connecting means comprises a weakened separation line.

3. The jacket of claim 1 wherein the connecting means comprises stitches or stitching.

4. The jacket of claim 1 wherein the connecting means comprises a bead seal.

5. The jacket of claim 1 wherein the covering means comprises a sheet of thermoplastic material.

6. The jacket of claim 1 wherein the mounting means comprises a display tab defining an aperture therein for mounting on the hanging rod of the display rack.

7. The jacket of claim 1 wherein the receiving means comprises at least two pockets.

8. The jacket of claim 1 wherein the receiving means comprises first and second pockets positioned in spaced relation on one side of the covering means.

9. The jacket of claim 8 wherein one pocket is larger than the other.

10. The jacket of claim 9 wherein the pockets are made of a transparent material to facilitate viewing of the insert therein.

11. The jacket of claim 5 wherein the thermoplastic sheet is opaque and pigmented to a desired color.

12. A jacket for protectively covering an insert, comprising:

a sheet of material having means for retaining said insert defined thereon, said retaining means comprising a sheet of material which is joined to the covering means along portions of its periphery to form a pocket having three closed sides for receiving a portion of the insert; and means joined to at least a portion of said sheet including at least one aperture formed therein for mounting said jacket on a display rack;

wherein said mounting means is at least partially joined to said sheet along a weakened separation line.

13. The jacket of claim 12 wherein said mounting means is substantially completely joined to said sheet along a weakened separation line.

14. The jacket of claim 12 wherein said sheet comprises a thermoplastic material.

15. A protective jacket for attachment to a display rod comprising:

first and second flaps joined along a center seal, each of said flaps having a pocket for the insertion of materials to be protected therein; and a tab member joined to at least a portion of said first and second flaps along a line of weakened separation, wherein said tab includes an aperture therein for mounting said jacket on said display rod.

16. The protective jacket of claim 15, wherein each of said pockets comprises a sheet of material sealed along outer edges of said flaps.

17. The protective jacket of claim 15, wherein said flaps are formed of a thermoplastic material.

18. A jacket for protectively covering an insert comprising:

first and second cover flaps joined along a central seal line;

a sheet of material defining a pocket on at least one of said cover flaps to receive at least a portion of said insert; and an elongated tab member having at least one aperture therein for mounting said jacket on a display rack.

19. The jacket of claim 18 wherein said tab member is connected to at least a portion of said cover flaps along a weakened separation line.

* * * * *